US006491793B2

(12) United States Patent
Kirvesmäki

(10) Patent No.: US 6,491,793 B2
(45) Date of Patent: Dec. 10, 2002

(54) ARRANGEMENT FOR FASTENING A TURBULENCE VANE TO A HEADBOX

(75) Inventor: Jarmo Kirvesmäki, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/995,212

(22) Filed: Nov. 26, 2001

(65) Prior Publication Data

US 2002/0062939 A1 May 30, 2002

Related U.S. Application Data

(60) Provisional application No. 60/313,677, filed on Aug. 20, 2001.

(30) Foreign Application Priority Data

Nov. 29, 2000 (FI) ..... 20002616

(51) Int. Cl.[7] ..... D21F 1/02
(52) U.S. Cl. ..... 162/343; 162/344
(58) Field of Search ..... 162/216, 336, 162/343, 344

(56) References Cited

U.S. PATENT DOCUMENTS

| | | | | | |
|---|---|---|---|---|---|
| 4,128,455 | A | * | 12/1978 | Justus | 162/343 |
| 4,133,715 | A | * | 1/1979 | Hergert | 162/343 |
| 4,181,568 | A | * | 1/1980 | Pfaler | 162/343 |
| 4,812,209 | A | * | 3/1989 | Kinzler et al. | 162/343 |
| 4,891,100 | A | * | 1/1990 | Hildebrand | 162/343 |
| 6,165,324 | A | * | 12/2000 | Linden | 162/343 |

FOREIGN PATENT DOCUMENTS

| | | |
|---|---|---|
| EP | 0951601 | 10/1999 |

* cited by examiner

*Primary Examiner*—Karen M. Hastings
(74) *Attorney, Agent, or Firm*—Fildes & Outland, P.C.

(57) ABSTRACT

An arrangement for fastening a turbulence vane to headbox where in the headbox, a groove running parallel to the width of the headbox is formed in a plate delimiting a slice chamber, in order to fasten the turbulence vane to the plate. A fastener is fitted to the rear edge of the turbulence vane, which is placed in a groove. In the turbulence vane a fastening retainer is formed, to which the fastener is fitted. In the fastener there is a coil spring construction arranged to lock onto the fastening retainer.

5 Claims, 3 Drawing Sheets

ARRANGEMENT FOR FASTENING A TURBULENCE VANE TO A HEADBOX

CROSS REFERENCE TO RELATED APPLICATION

This application claims the benefit of U.S. Provisional Application No. 60/313,677 filed Aug. 20, 2001.

FIELD OF THE INVENTION

This invention relates to an arrangement for fastening a turbulence vane to a headbox, in which headbox there are openings for the stock flow formed in the plate delimiting the slice chamber, as well as at least one continuous groove running parallel to the width of the headbox and located in the area between the openings in order to fasten a turbulence vane to the said plate on the slice chamber side, while a fastener which is arranged to be placed in the said groove is fitted to the rear edge of the turbulence vane.

BACKGROUND OF THE INVENTION

Nowadays, special turbulence vanes are used in the slice chamber after the turbulence generator in the headbox of a paper machine. The turbulence vanes are also termed strips or lamellae, a single slice chamber generally containing a total of one to six of them. With the aid of the wall friction of the turbulence vanes, the desired level of turbulence is intended to be maintained to the slice opening and as far as the wire section, so that the fibers in the stock flow will be as randomly oriented as possible when they are discharged from the headbox. This is used to affect the tensile strength of the material being manufactured and the orientation of the tensile strength in different directions in the material. Particularly in the multilayer headboxes used in soft tissue machines, turbulence vanes are also used to separate the different stock layers from each other, which improves the layer purity of the fibers, as well as their orientation.

In the state of the art, a fastener, which is welded or glued to a usually plastic turbulence vane, is used to attach the turbulence vane to the plate delimiting the slice chamber. The turbulence vane is secured, with the aid of a fastener, to a groove machined in the plate. In order to improve the durability of the turbulence vanes and to increase their operating life, attempts are being made, however, to use new kinds of materials, which will resist high temperatures and chemicals. It is impossible, or at least extremely difficult, to glue or weld materials of this kind, such as the so-called fluoroplastics. In addition, welding often causes distortions or strain in the material, which can lead to unpredictable breakages during operation.

FI publication print number 55372 also discloses a fastener, which is glued onto the turbulence vane. The fastening in question is, however, unreliable and it requires a specific kind of groove in the plate. The same publication also discloses another fastener, which is not actually attached to the turbulence vane. The fastening is based on the friction that is created between the turbulence vane and protrusions on the fastener. This fastening is particularly unreliable and its manufacture and installation is difficult. The rotation of the turbulence vane permitted by the fastener is, in addition, extremely limited.

SUMMARY OF THE INVENTION

The present invention provides a new type of arrangement for fastening a turbulence vane to a headbox, wherein a turbulence vane can be fastened to a headbox more easily and also more securely than previously.

An arrangement for fastening a turbulence vane to headbox, in which headbox there are openings for the stock flow formed in the plate delimiting the slice chamber, as well as at least one continuous groove running parallel to the width of the headbox and located in the area between the openings in order to fasten a turbulence vane to the plate on the slice chamber side, while a fastener, which is arranged to be placed in the groove, is fitted to the rear edge of the turbulence vane, is characterized in that in the base material of the turbulence vane a fastening retainer is formed, to which the fastener, with a construction arranged to lock onto the fastening retainer, is fitted, and which forms a hinge member permitting the turbulence vane to turn.

In the arrangement there are at least two fasteners and they are arranged to fit entirely into the groove, which is preferably a dovetail groove. The fastening retainer is formed of drill holes, which are arranged in a row running in the direction of the width of the headbox. The drill holes, the diameter of which is 2–6 mm, are machined at a distance of 3–25 mm, from the rear edge of the turbulence vane, and at 5–30 mm, intervals in the direction of the width of the headbox.

In the arrangement the fastener is a coil spring, which is fitted in to the drill holes forming the fastening retainer, the coils of the coil spring forming the construction. The pitch of the coil spring, which comprises acid-resistant steel, is the distance between the drill holes, or a multiple of the distance.

The fastening retainer is formed by at least one groove running parallel to the width of the headbox and machined in the upper and/or lower surface of the turbulence vane. The groove is machined at a distance of 5–25 mm, from the rear edge of the turbulence vane.

The fastener which has an essentially circular cross-section is of a plastic material. A construction locking onto the fastening retainer is shaped in a throat formed in it.

The length of the fastener running in the direction of the width of the headbox is 50–350 mm, and that these are arranged in the turbulence vane at intervals of 100–500 mm.

In the arrangement according to the invention, special fasteners are used, by means of which gluing and welding are avoided. Thus, it is possible to use materials resistant to high temperatures and various chemicals, which it would be difficult to glue, weld, or join in other ways. According to the invention, there are constructions corresponding to each other in both the turbulence vane and the plate, which lock into each other. Gluing and welding are then unnecessary. In addition, the fastener can be manufactured from a different material than the turbulence vane. The fasteners can also be manufactured in several different ways and they permit thermal expansion in adjacent structures. In addition to attachment, the fastener also forms a hinge member, which permits the turbulence vane to turn freely. Further, the fastener according to the invention is suitable for use directly in the existing conventional grooves in a headbox.

These and other features and advantages of the invention will be more fully understood from the following detailed description of the invention taken together with the accompanying drawings.

DETAILED DESCRIPTION OF THE INVENTION

Figure 1:
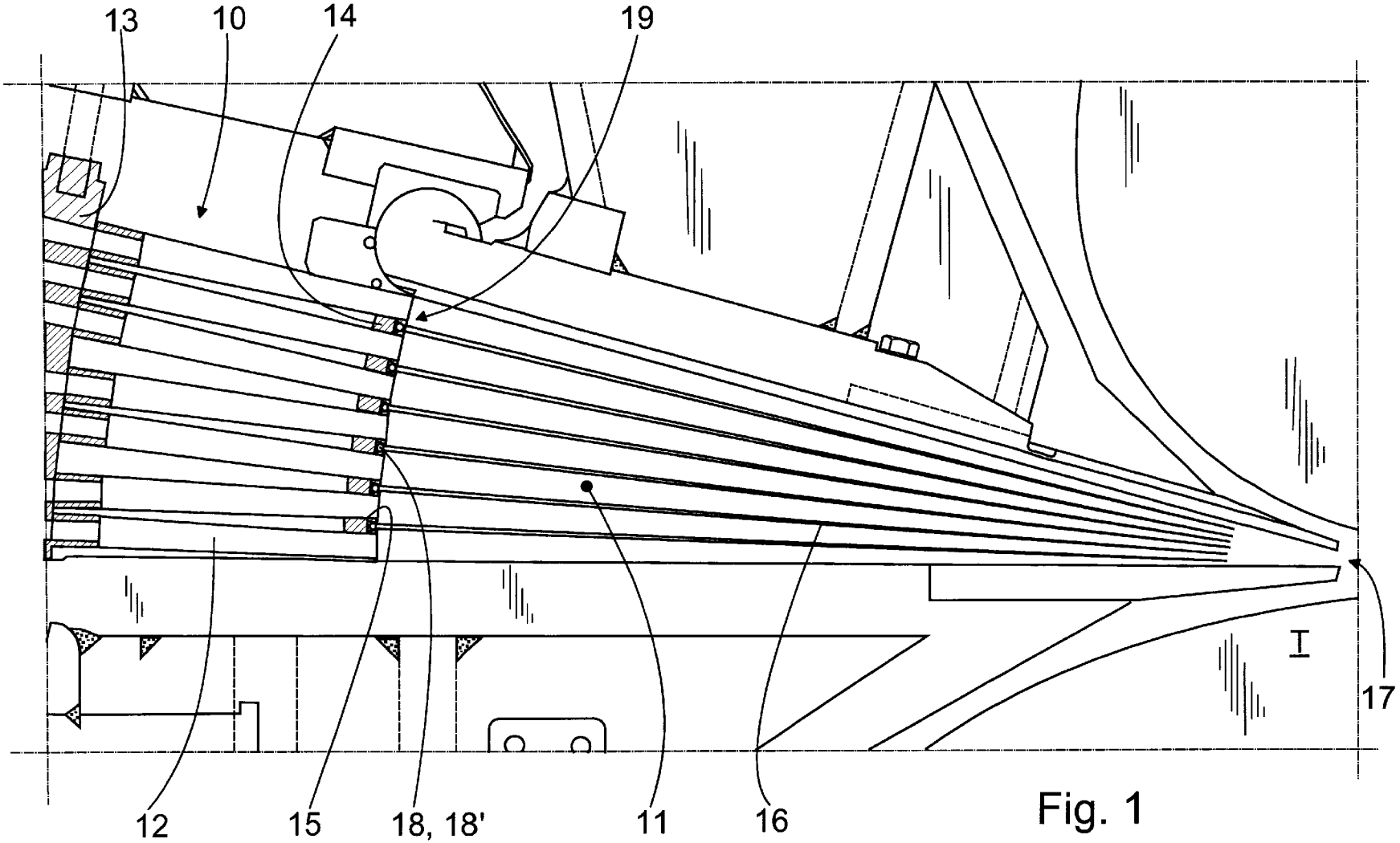
FIG. 1 shows a part of the headbox of a paper machine in cross-section and equipped with an arrangement according to the invention.

FIG. 1 shows part of a paper or board machine headbox that is, as such, conventional. As is known, the watery stock used in the manufacturing process is fed through a turbulence generator 10 into a slice chamber 11. By means of the turbulence generator 10, the fibers of the stock are intended to be separated from each other and to be orientated in the most irregular relationship possible to one another. In this case, the turbulence generator 10 is formed of several tubes 12, which are supported at both ends on sturdy plates 13 and 14. Openings 15, into which the said tubes 12 are set, are machined in the plate delimiting the slice chamber 11. In FIG. 1, the tubes 12 are in seven rows on top of each other, which extend over the entire width of the headbox. The tubes 12 are set at a certain angle to each other, so that the flows discharging from the tubes of the various rows will combine in the slice opening 17. FIG. 1 does not, however, show the stock or its flows. In the slice chamber 11, after the turbulence generator 10, there are turbulence vanes 16, by means of which the FIG. d level of turbulence is maintained to the slice opening 17 and at least as far as the wire section. From the turbulence opening 17, the stock discharges at this point onto the wire carried by the roller T and is carried forward by it.

In the headbox of FIG. 1, there are six turbulence vanes 16, each of which is fastened to the headbox in the manner according to the invention. For fastening, there is suitable fastener 18 or 18' at the end of the turbulence vane 16 and a groove 19 in the plate 14 delimiting the slice chamber 11. The groove 19 located in the area between the openings 15 runs in the direction of the width of the headbox and is continuous. According to the invention, a fastening retainer 20 is formed in the base material of the turbulence vane 16, to which the said fastener 18 or 18' is fitted. The fasting retainer is thus part of the turbulence vane. In the fastener 18 or 18', there is also a construction arranged to lock onto the fastening retainer 20. Further, the fastener 18 or 18' forms a hinge member that permits the rotation of the turbulence vane. The arrangement in question is easy to manufacture and creates a reliable fastening of the turbulence vane to the plate. In addition, the manufacturing of the arrangement avoids welding, gluing, and other forms of joining. This makes it possible to use durable materials, that are, however, difficult to joint using the prior art. Later, the description will examine the arrangement according to the invention in the case of a single turbulence vane. Nevertheless, the characteristics described apply to all turbulence vanes.

Generally, there are at least two fasteners in each turbulence vane. Thus, the fasteners permits the thermal expansion of the structures. In addition, the fasteners are arranged to fit entirely into the groove, thus forming the said hinge member. Thus, the turbulence vane can turn according to the stock flow, without detrimental strain. At the same time, the arrangement has no effect on the stock flow and the dirtying of the structures is minimal. According to FIG. 3*a*, the groove 19 is preferably a dovetail groove, which is commonly used headboxes nowadays.

Figure 2:
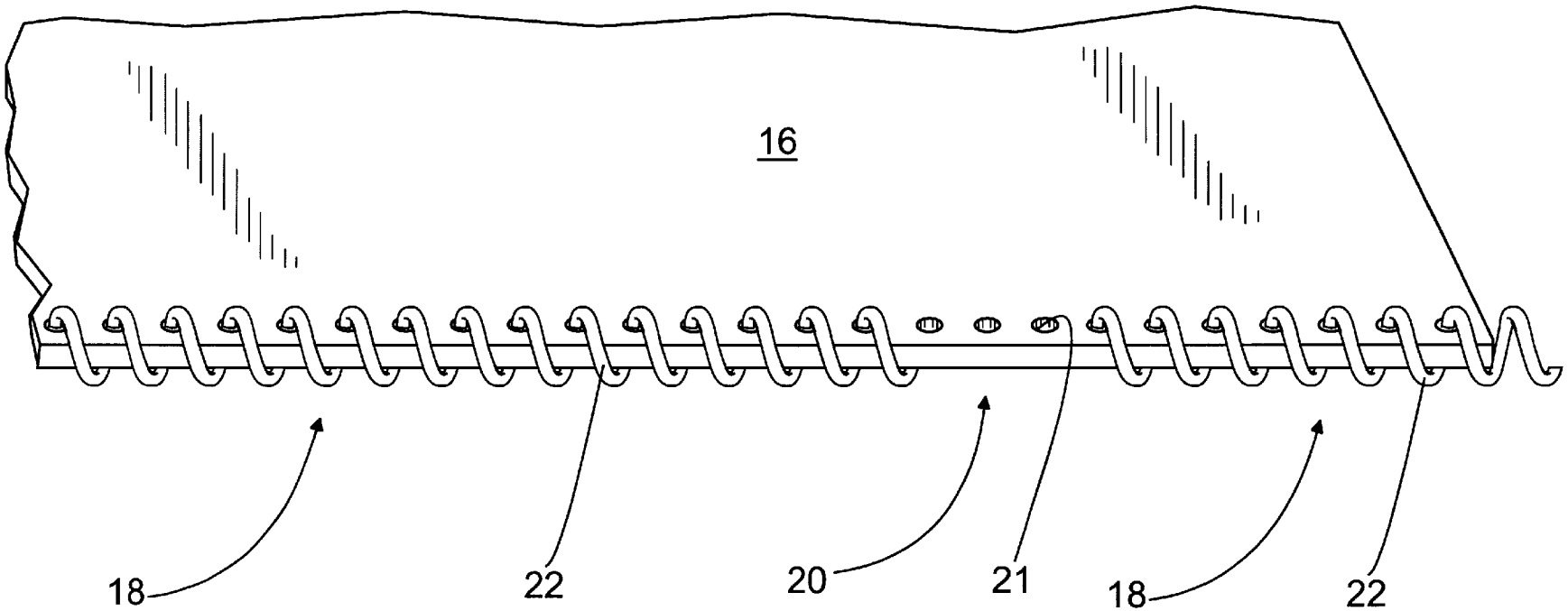
FIG. 2 shows the fastener used in the arrangement according to the invention, attached to a turbulence vane.

FIG. 2 shows one turbulence vane 16 applied in the arrangement according to the invention and a fastener 18 fitted to it. In this case, the fastening retainer 20 is formed by drill holes 21 machined in the turbulence vane 16, which are arranged in a row parallel to the width of the headbox. The drill holes 21 are preferably manufactured mechanically in large series using several drill bits, such as, for example, are used in drilling the mantles of vacuum rolls. The drill holes 21, the diameter of which is 2–6 mm, preferably 3–4 mm, are machined at a distance of 3–25 mm, preferably 5–15 mm from the rear edge of the turbulence vane 16. The drill holes 21 are arranged at 5–30 mm, preferably 1–15 mm intervals across the width of the headbox. Thus, the drill holes have an advantageously small effect on the strength of the turbulence vane. During the manufacturing stage, the row of drill holes can be made to deviate from the line of the rear edge of the turbulence vane, in which case desired compensation forces can be created in the turbulence vane. Here, the term drill hole generally refers to an opening, into which the fastener can be placed. Besides drilling, some other suitable manner of machining can be used. Besides a circular drill hole, some other shape of opening can also be used, though a circular drill hole is preferable in terms of the durability of the turbulence vane.

Figure 3A:
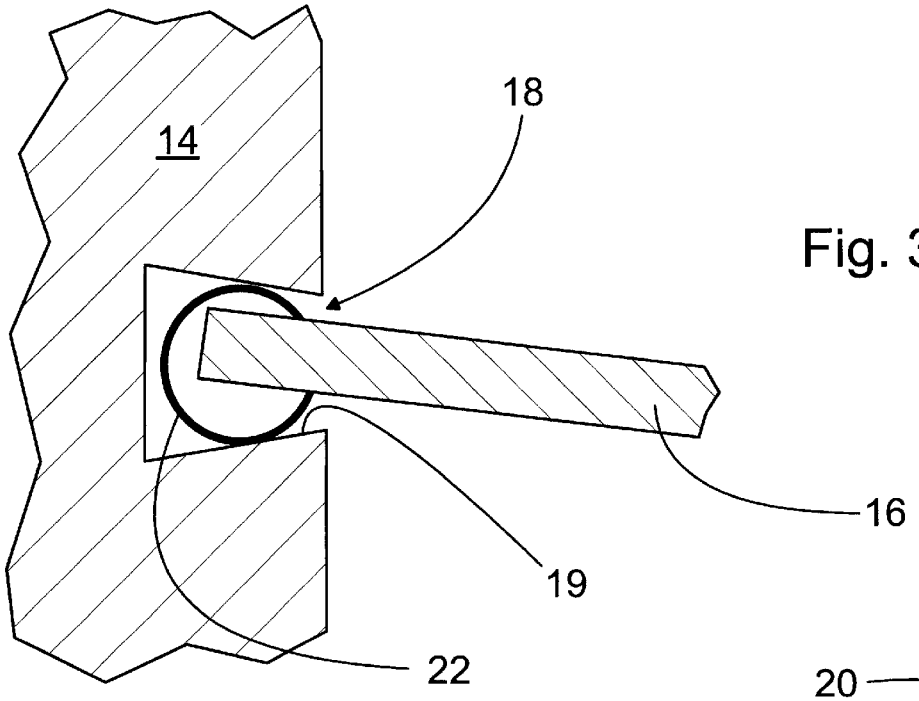
FIG. 3*a* shows a cross-section of the arrangement according to the invention.

One preferred fastener 18 according to the invention is a coil spring 22, which is fitted into the drill holes 21 forming the fastening retainer 20. In this case, the coils of the coil spring 22 form the said structure locking onto the fastening retainer 20 (FIG. 2). In order to facilitate installation, the pitch of the coil spring of acid-resistant steel is the distance between the drill holes or a multiple of the distance. Thus, a preferably accurately dimensioned coil spring can be installed successfully even in a wide turbulence vane, by simply rotating the coil spring. The thickness of the material of the coil spring is slightly less than the diameter of the drill hole used, so that installation can be carried out as described. In addition, it is preferable to install the coil spring in two parts, from both ends of the turbulence vane. After the fasteners has been installed, the turbulence vane is pushed into the groove, from the side of the headbox. As well as, or instead of pushing, the turbulence can be pulled, using some suitable tool. FIG. 3*a* shows an arrangement according to the invention, based on a coil spring 22, ready for use.

The arrangement described above is simple to manufacture and is durable. In addition, the coils of the coil spring form several attachment points in the groove, so that the friction forces are small. This makes the turbulence vane easy to move. In addition, when the turbulence vane expands thermally, the coil spring gives way due to its structure. Thus, the turbulence vane remains unstressed. In addition, large gaps remain between the coil spring and the groove, so that it is unlikely that fine material will collect in the groove.

Figure 3B:
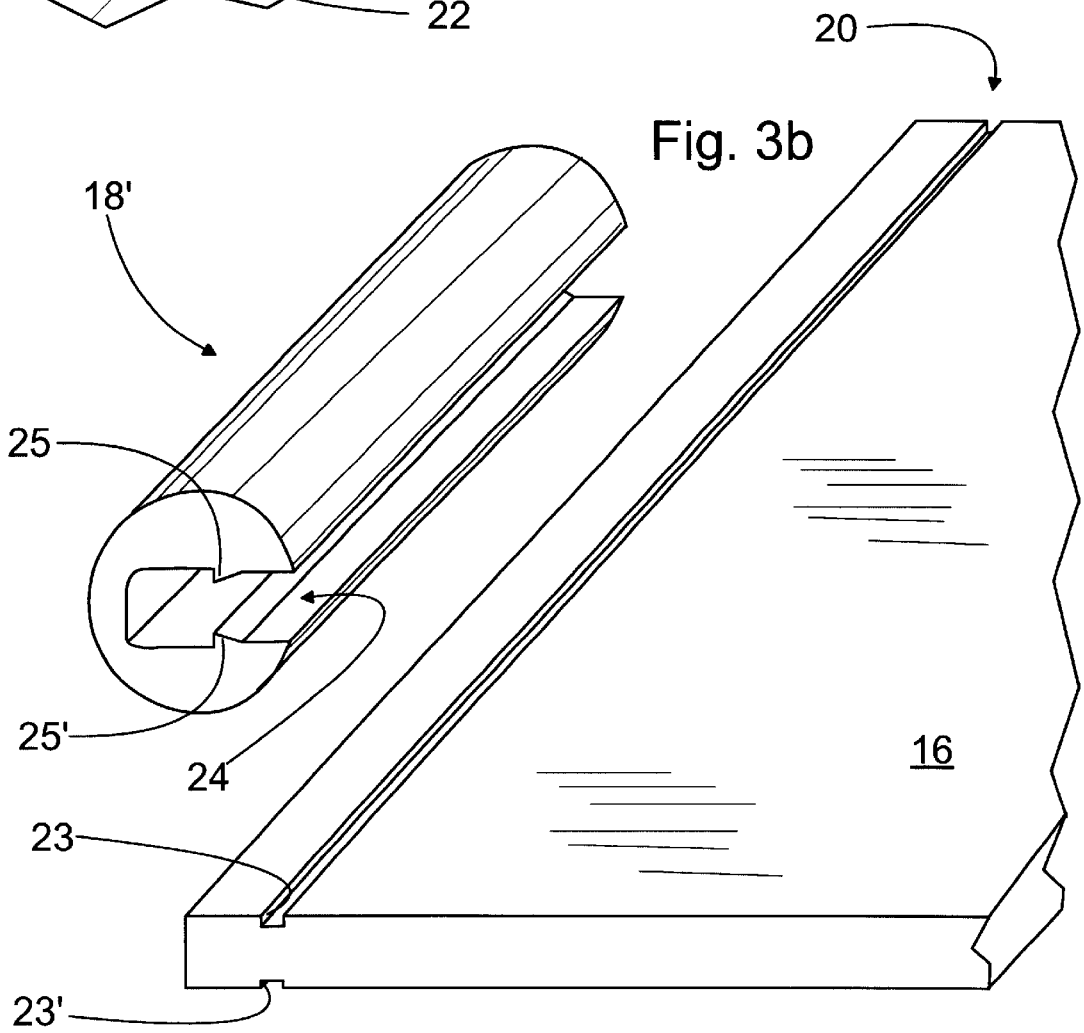
FIG. 3*b* shows a second embodiment of the fastener used in the arrangement according to the invention and an axonometric view of part of a turbulence vane.

FIG. 3*b* shows part of another arrangement according to the invention. In this case, the fastening retainer 20 is formed by grooves 23 and 23' machined in the rear part of the turbulence vane 16. Generally, there are one or several grooves 23 and 23' running parallel to the width of the headbox and they are machined into the upper and/or lower surface of the turbulence vane 16. In FIG. 3*b*, the grooves are continuous and extend over the whole distance of the turbulence vane 16. Alternatively, the grooves can be the length of the fasteners used, so that the strength of the turbulence vane is reduced as little as possible by the grooves. Generally, the groove 23 and 23' or similar is machined at a distance of 5–25 mm, preferably 10–20 mm, from the rear edge of the turbulence vane. Thus, a sufficient support surface is achieved for the fastener, while still allowing the fastener to fit into the groove. The same reference numbers are used for components that are functionally similar.

Many kinds of fasteners can be attached to the grooves 23 and 23' machined in the turbulence vane 16. The cross-section of the fastener 18' according to FIG. 3*b* is, however, essentially circular. This makes it easy to create a hinge member permitting the turbulence vane to turn. In addition, the fastener is preferably manufactured from a plastic material, so that extrusion, for instance, can be used as the manufacturing method. A throat 24 is formed in the fastener 18' of FIG. 3*b*, in which protrusions 25 and 25' are formed to create a construction that locks onto the fastening retainer 20. The shape shown can be manufactured using, among other methods, the said extrusion. Generally the fastener 18' can be installed in the grooves 23 and 23' from the ends of the turbulence vane 16, but, by suitably dimensioning the fastener 18', resilient properties can be created in it (FIG. 3*b*). Thus, the fastener 18' can be simple pushed in the direction of the turbulence vane 16, so that the fastener 18' locks onto the rear edge of the turbulence vane 16.

To facilitate installation and reduce material costs, the fasteners 18' described in the previous paragraph are preferably manufactured as short pieces. Generally, the length of the fastener in the direction of the width of the headbox is 50–350 mm, preferably 100–250 mm. In addition, the fasteners are arranged at intervals of 100–500 mm, preferably 200–400 mm. A few standard-size fasteners will, however, achieve a sufficiently reliable attachment of the turbulence vane. At the same time, fasteners that are set apart from each other will permit thermal expansion in the turbulence vane.

By suitably shaping protrusions in a one-piece fastener, the fastener can also be attached in drill holes. Thus, grooves need not be machined in the turbulence vane, the thickness of which is generally 3–6 mm. Thanks to the arrangement according to the invention, materials that were previously regarded as impossible can be used to manufacture turbulence vanes. One preferred material for use in an embodiment is PVDF plastic, one trade name for which is Kynar. This plastic will resist even very high temperatures and a variety of chemicals. These properties are significant when washing headboxes, when hot water and various cleaning agents are used. Thus, the turbulence vanes can even remain in place when the headbox is washed, whereas at present they must be removed. The arrangement is also easy to apply, as it suits present headboxes without alterations.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An arrangement for fastening a turbulence vane in a headbox, which headbox has, for forming a stock flow, a slice chamber delimited by a plate, and in which headbox there are openings for the stock flow formed in the plate, as well as at least one continuous dovetail groove running parallel to the width of the headbox and located in the area between the openings in order to fasten a turbulence vane to the said plate on the slice chamber side, while a fastener, which is arranged to be fitted entirely into the said dovetail groove, is fitted to the turbulence vane at its rear edge, and which fastener forms a hinge member permitting the turbulence vane to turn, characterized in that in the base material of the turbulence vane a fastening retainer is formed, to which the said fastener, with a construction arranged to lock onto the fastening retainer, is fitted, and the fastening retainer is formed of drill holes, which are arranged in a row running in the direction of the width of the headbox, and the fastener is a coil spring, which is fitted in to the drill holes forming the fastening retainer, the coils of the coil spring forming the said construction.

2. An arrangement according to claim 1, characterized in that there are at least two coil springs.

3. An arrangement according to claim 1, characterized in that the drill holes, the diameter of which is 2–6 mm, is machined at a distance of 3–25 mm, from the rear edge of the turbulence vane, and at 5–30 mm, intervals in the direction of the width of the headbox.

4. An arrangement according to claim 1, characterized in that the pitch of the coil spring is the distance between the drill holes, or a multiple of the distance.

5. An arrangement according to claim 4, characterized in that the coil spring is made of acid resistant steel.

* * * * *